United States Patent [19]

Freermann

[11] Patent Number: 4,609,182

[45] Date of Patent: Sep. 2, 1986

[54] DEVICE FOR TENSIONING AND ALIGNING A FABRIC

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 653,506

[22] Filed: Sep. 21, 1984

[30] Foreign Application Priority Data

Sep. 24, 1983 [DE] Fed. Rep. of Germany ... 8327505[U]
Sep. 24, 1983 [DE] Fed. Rep. of Germany ... 8327506[U]
Aug. 24, 1984 [DE] Fed. Rep. of Germany ..... 3431210

[51] Int. Cl.[4] ..... B26D 7/14; B25B 25/00

[52] U.S. Cl. ..... 254/228; 83/175; 254/199; 269/266

[58] Field of Search ..... 254/199, 201, 228; 83/175; 26/16, 18, 51.3, 51.4; 269/266

[56] References Cited

U.S. PATENT DOCUMENTS

| | | | |
|---|---|---|---|
| 2,966,086 | 12/1960 | Sjöstrom | 83/175 |
| 3,108,508 | 10/1963 | Warden | 269/266 X |
| 3,192,811 | 7/1965 | Simmons | 83/175 |
| 4,034,634 | 7/1977 | Arbter | 83/175 X |
| 4,493,234 | 1/1985 | Ziegler et al. | 26/51.4 X |

FOREIGN PATENT DOCUMENTS

| | | |
|---|---|---|
| 2544410 | 3/1979 | Fed. Rep. of Germany . |
| 3024389 | 1/1982 | Fed. Rep. of Germany . |
| 1374528 | 1/1982 | France . |
| 711117 | 6/1954 | United Kingdom . |
| 1239491 | 7/1971 | United Kingdom . |
| 1277646 | 6/1972 | United Kingdom . |
| 1511785 | 5/1978 | United Kingdom . |

*Primary Examiner*—Stuart S. Levy
*Assistant Examiner*—Joseph J. Hail, III
*Attorney, Agent, or Firm*—Karl F. Ross; Herbert Dubno

[57] ABSTRACT

A device for tensioning and aligning a fabric includes a support member to which a plurality of tensioning segments are connected such that each of the segments in automatically lifted when a longitudinal hem of the fabric passes thereunder. The support member is provided with a guide plate at each vertical end which guide plates face each other and project into associated slots provided at the vertical ends of the segments with a play so as to allow a limited vertical movement as well as a limited horizontal movement of the segments along the guide plates. Each of the segments has a main body which is provided with a finger-like step-shaped extension so as to define a projection facing the fabric and a space which embraces the respective edge of a nap zone with a certain clearance.

12 Claims, 4 Drawing Figures

DEVICE FOR TENSIONING AND ALIGNING A FABRIC

FIELD OF THE INVENTION

My invention relates to a device for tensioning and aligning a fabric which device cooperates in particular with a cross cutting arrangement for cutting the fabric into pieces of equal length.

BACKGROUND OF THE INVENTION

From the German publication DE-OS No. 30 24 389, there is known an arrangement for aligning a web of fabric and including a pair of tensioning blocks arranged parallel to each other and being engageable with a napless or loopless zone of the fabric at opposing sides of the zone. When being in the lowered position, the tensioning blocks stretch the fabric so as to align the latter for an associated crosscutter which cuts the web of fabric transversely to the conveying direction of fabric. The conveyor on which the web of fabric is transported operates in an intermittent manner which means that each time a napless zone is located beneath the tensioning blocks, the conveyor is stopped and these blocks are lowered to act on the fabric. When lowered onto the fabric, each tensioning block will lie against the edge of the respective nap zone. The blocks are then moved apart to stretch the napless zone and align the latter to allow an accurate separating line obtained by the associated crosscutter. Each of the tensioning blocks includes a plurality of segments arranged side by side and provided with cutouts of which at least one is manually adjustable for allowing, e.g., a longitudinal hem or border portion to pass the block and to be prevented from interfering with the tensioning and aligning step of the fabric i.e. the napless zone of the fabric.

When the blocks are lowered and provide a tensioning of the napless zone, the cross cutting device cuts along the center line of the napless zone to produce pieces of fabric, like towels of equal length. It is obvious that the tensioning blocks must be adjusted exactly symmetrically with respect to the cross cutting device in order to provide a separating line exactly centered along the napless zone.

Like tensioning blocks are known from the French Pat. No. 13 74 528.

The tensioning blocks described in the prior art have, however, the disadvantage that the cutouts for the hem or border portion of the fabric must continuously be adjusted to the flow or pattern of the hem portion since the fabric when transported to the crosscutter will not be provided with longitudinal hems exactly parallel to the conveying direction i.e. the longitudinal hem portion will rather have a somewhat wavelike pattern. Consequently, the adjustment of the cutouts for the hem portion requires a cumbersome manual work which is undesired with respect to an economical operation.

Moreover, it has been shown that the segments of the tensioning block tend to slide with their respective edge on or over the nap zone of the fabric so that the alignment and stretching of the napless zone is considerably impaired.

OBJECT OF THE INVENTION

It is thus the object of my invention to provide an improved tensioning block which automatically allows adjustment to the flow or run of the hem portion or longitudinal seam of a textile web and is prevented from sliding on or over the nap zone of the fabric.

SUMMARY OF THE INVENTION

I realize this object, in accordance with the present invention, by connecting the tensioning segments to the support member in a manner that each segment is automatically moved in upward direction when a longitudinal hem or border portion is passed by the tensioning block. Consequently, regardless of the pattern of the longitudinal hem portion, a cutout for the latter at the correct location is continuously provided. It is not necessary to manually adjust the segments each time the hem portion deviates from its extension parallel to the conveying direction so that the tensioning and alignment of the fabric can be executed in an economical manner.

For achieving the independent movement of each segment, the invention provides each segment with opposing slots which cooperate with associated guide plates of the support member such that the guide plates project into the respective slot with a play i.e. that the distance between facing ends of the slots is smaller than the distance between facing ends of the guide plates. In addition, the segments are provided with a clearance to the portion of the support member arranged above the segments so that each of the latter can be lifted by the longitudinal hem portion while guided along the guide plates.

According to a further feature of my invention, each tensioning segment has a square main body which is provided with a step-shaped finger-like extension. Through the so-formed projection and the space defined by the step shape of the extension, the segment can lie against the nap zone in an optimum manner without risking a sliding on or over the edge of the nap zone, the more so as the edge of the projection facing the nap zone is sharp-edged e.g. by a right angle.

The tensioning segments are relatively narrow and of small weight so that mounting and guiding of the segments is simple and moreover they can easily adapt to the web of fabric in view of the minor inert mass.

The width of the projection is selected to be approximately half the width of the hem portion of a fabric which is to be stretched by the tensioning block. The depth of the projection should be very small in order to obtain a needle-like formation but nevertheless of sufficient strength to prevent bending thereof. The length of the projection is so dimensioned that a play between adjacent segments and the nap zone of the web of fabric is obtained.

BRIEF DESCRIPTION OF THE DRAWING

The above and other features of my present invention will now be described in detail with reference to the accompanying drawing in which.

SPECIFIC DESCRIPTION

Figure 1:
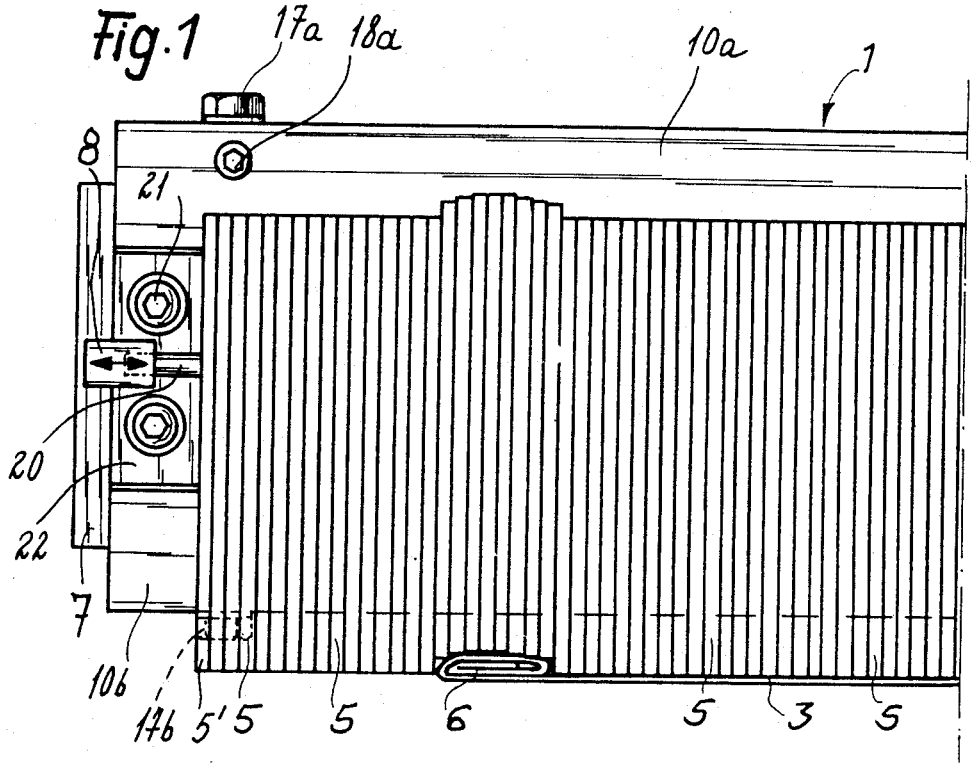
FIG. 1 is a rear view of a tensioning block according to the invention.

In the drawing, there is shown one tensioning block 1 which cooperates with a further tensioning block (not shown) in order to provide a stretching and alignment of a fabric 30. The tensioning block 1 forms a part of a cross cutting device (not shown), however, I may note that the described block may certainly be used also for other arrangements requiring an alignment of the fabric 30.

The apparatus has been described for a transverse cutting unit although it is also usable for other textile aligning and orienting purposes.

The fabric 30 is transported along a conveyor 4 of any suitable design and includes a nap zone 2 which is sectioned by napless zones 3 spaced at a distance to each other along the fabric 30. The conveyor 4 operates intermittently so that each time a napless zone which constitutes the zone to be severed is transported to a location beneath the tensioning block 1, the conveyor stops and allows the tensioning and cutting of the fabric 30.

Figure 2:
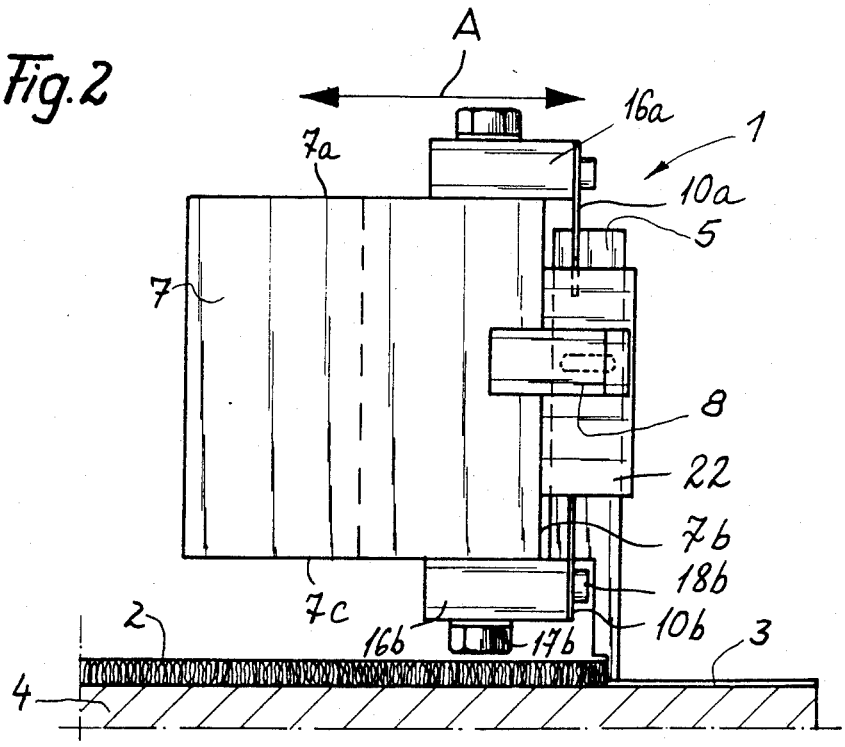
FIG. 2 is a side view of the tensioning block of FIG. 1.
Figure 3:
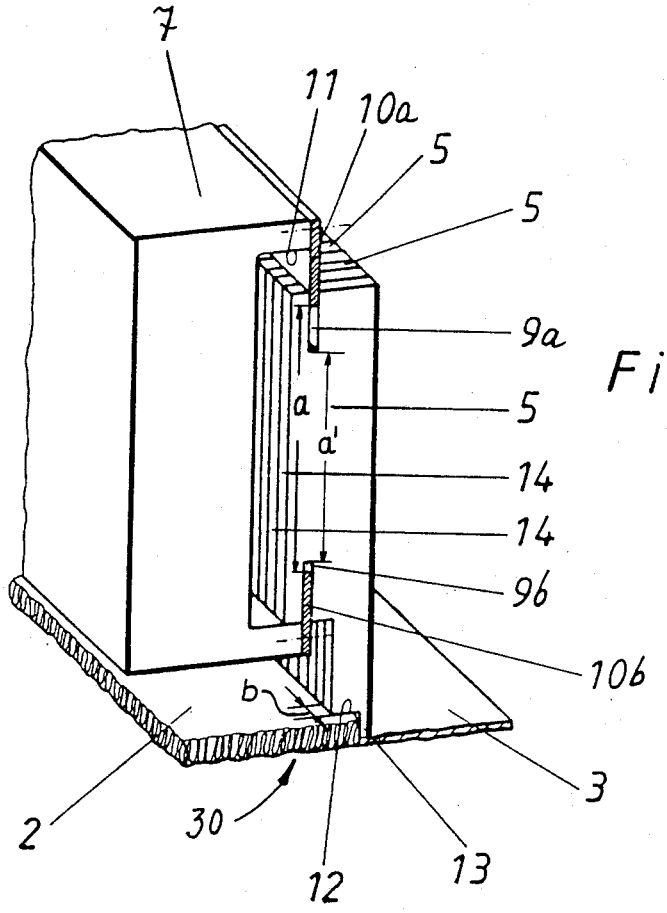
FIG. 3 is a perspective view of the tensioning block of FIG. 1.

The tensioning block 1 includes a support member 7 essentially of square cross-section. Arranged on the top 7*a* of the support member 7 is a girder 16*a* which is fastened thereon by a screw 17*a*. The girder 16*a* extends transversely to the conveying direction (indicated by arrow A in FIG. 2) of the conveyor 4 and projects beyond the front face 7*b* of the support member 7. Likewise, a further girder 16*b* is fastened by a screw 17*b* to the bottom 7*c*. The girder 16*b* extends parallel to the girder 16*a* and projects also beyond the front face 7*b* of the support member 7. In this connection, I may note that it is certainly possible to omit the girders 16*a*, 16*b* and to provide the support member 7 with a U-shaped cross-section as shown in FIG. 3 to obtain such projecting portions.

To each of the girders 16*a*, 16*b*, a guide plate 10*a*, 10*b* is fastened by means of a screw 18*a*, 18*b*, respectively, which as in the present embodiment may be a hexagonal head screw. Each of the guide plates 10*a*, 10*b* extends along the respective girder 16*a*, 16*b* and project inwardly toward each other so as to have a distance a (FIG. 3) between the opposing front edges. The support member is connected to a not shown drive mechanism in order to be movable between an upper position and a lower position at which an engagement with the fabric 30 is obtained as will be described hereinbelow.

The support member 7 is provided to hold a plurality of tensioning segments 5 each having a narrow and square main body 15. Arranged at a distance to its forward front portion 14, the main body 15 is provided with two slots 9*a*, 9*b* opposing each other and being open toward the outside. By means of the slots 9*a*, 9*b*, each segment 5 can be slid along the guide plates 10*a*, 10*b*. As is shown in FIG. 3, the opposing ends of the respective slots 9*a*, 9*b* have a distance a' from each other which is smaller than the distance a between the opposing edges of the guide plates 10*a*, 10*b* projecting into the slots 9*a*, 9*b*. Thus, the guide plates 10*a*, 10*b* project into the associated slot 9*a*, 9*b* with a play.

In addition, the top portion of each segment 5 is provided at a distance to the girder 16*a* or respective portion of the support member 7 (FIG. 3) to define a clearance 11. In view of the clearance 11 and the fact that the guide plates 10*a*, 10*b* project into the respective slot 9*a*, 9*b* with play, each segment 5 can automatically be moved in vertical direction when for example a longitudinal hem or border portion 6 passes which is located along the outer edge of the web of fabric 30. This means, when the fabric 30 is conveyed to the location beneath the tensioning block 1, the respective segments 5 are simply shifted upwardly by the passing hem portion—in the present case the longitudinal hem portion 6 without interfering with the remaining segments 5 engaging the napless zone 3. The segments 5 which are already described are movable to a limited degree in vertical direction of the support member 7 are also provided with a limited play in horizontal direction i.e. parallel to the longitudinal elongation of the support member 7. The latter play is, however, limited to a necessary degree.

Figure 4:
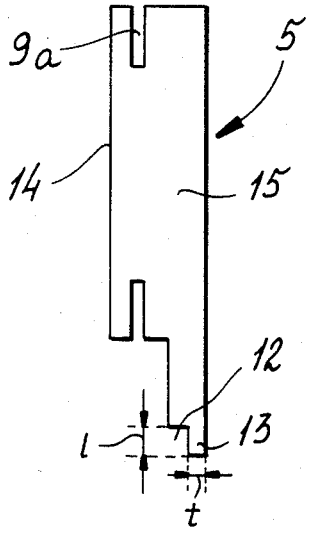
FIG. 4 is a side view of a single segment of the tensioning block.

As is shown especially in FIG. 4, the main portion 15 of each segment 5 is provided with a finger-like step-shaped extension 13' at its end facing the fabric 30. The extension 13' includes a projecting member 13 and defines a rectangular space of a height corresponding approximately to the height of the nap zone 2. Consequently, when the segments 5 are lowered toward the fabric 30, the projection 13 will engage on the napless zone 3 and slide against the edge of the nap zone 2 when the tensioning block 1 is moved in direction toward the nap zone 2. The space 12 then encompasses the respective portion of the nap zone 2 with a certain clearance. Since the projection 13 is relatively narrow and formed almost as a needle, the sliding of the projection 13 on or over the nap zone 2 is prevented.

I have found that it is especially advantageous to provide the projection 13 with a width b of approximately 4 mm, a depth t of approximately 2 mm and a length l of approximately 5 mm. In order to guarantee to prevent a sliding on or over the nap zone 2, the guide edge of the projection 13 lying against the nap zone is provided in a sharp-edged manner, in particular in a right-angled manner.

I may note that it is common to provide support bars (not shown) underneath the web of fabric 30 which bars cooperate with the tensioning blocks 1 during the stretching step and are simultaneously moved with the tensioning blocks.

For providing an exact alignment and tensioning of the napless zone 3 of the fabric 30, it is preferable to fix the position of the segments 5 relative to each other once the segments 5 lie against the nap zone 2 and certain segments 5 are respectively lifted by the hem portion 6. Thus the hem portion 6 is also aligned parallel to the conveying direction of the conveyor 4 when the tensioning blocks 1 are moved in opposing directions to tension the napless zone 3. In this connection, I may note that suitable drive mechanisms not only move the support member 7 between the upper and lower positions but also provide the movement of the blocks 1 away from each other in horizontal direction. For reasons of simplicity, the drive mechanisms are, however, not shown.

The fixation of the segments is obtained by a clamping device whose housing portion 22 is connected to the support member 7 by fastening means 21 and which includes a pneumatic working cylinder 8 cooperating with a push rod 20. The push rod 20 is shiftable against the outermost segment 5' (FIG. 1) when, e.g., air is admitted into the working cylinder 8 to build up the pressure and to move the push rod 20 accordingly. Through the force applied by the push rod 20 on the outermost segment 5', the remaining segments 5 are pressed together and thus prevented from executing any movement. The clamping or fixation of the segments 5 is maintained until the tensioning and the subsequent separating provided by a cross cutting device (not shown) has occurred. The pressure in the working cylinder is then released so that the segments 5 are freely movable again.

Preferably, the tensioning segments 5 have a width between 4–8 mm.

After having described the individual parts of the invention, I will now describe the mode of operation in connection e.g. with a cross cutting device.

The web of fabric 30 which is provided with a plurality of napless zones spaced from each other in elongated direction of the fabric 30 is placed on the conveyor 4 such that the longitudinal hem or border portion 6 extends in conveying direction. The conveyor 4 transports the fabric 30 until the most forwardly located napless zone is beneath the pair of tensioning blocks 1 (only one is shown in the drawing). Then the conveyor is stopped and the tensioning blocks 1 are lowered onto the napless zone 3 of the fabric 30 until the associated projection 13 rests thereon. Subsequently, the blocks 1 are moved apart in opposite direction until the projections 13 and thus the segments 5 which are arranged transversely to the conveying direction lie against the nap zone 2 and cause a tensioning of the napless zone. The longitudinal hem portion 6 will automatically lift the respective segments 5—as shown in FIG. 1—when the blocks 1 are lowered and shifted so that the tensioning step will not be affected. Once the tensioning has been obtained, air is admitted into the working cylinder 8 so that the push rod 20 clamps and fixes the arrangement of the segments 5. The napless zone is then cut exactly along its center by the cross-cutter. After the tensioning blocks have been lifted again, the conveyor 4 is actuated to transport the web of fabric 30 until the next napless zone 3 is beneath the blocks 1 so as to repeat the cycle.

The assembly of the tensioning block 1 is rather simple by sliding the segments from one side along the guide plates 10*a*, 10*b* which engage into the respective slots 9*a*, 9*b* of the main body 15 of the segments 5. When the last segment 5 is arranged in the support member 7, e.g. a metal piece can be screwed on to close this side of the block. The other side of the block is confined by the clamping device. Thus, the segments 5 cannot become lost and are supported in such a manner that they can execute a movement nevertheless. When the tensioning segments are connected to the support member 7, the lower girder 16*b* serves as support for the segments 5 while—as already mentioned—the upper girder is arranged at a distance to the segments to define the clearance 11.

I claim:

1. A device for tensioning and aligning a fabric, comprising:

a support member having a horizontal and a vertical axis, said support member being lowerable toward the fabric;

a plurality of tensioning segments arranged side by side in direction of said horizontal axis and acting on the fabric when said support member is in the lower position;

connecting means for attaching said tensioning segments to said support member in such a manner that each of said tensioning segments is individually and automatically liftable in direction of said vertical axis, said connecting means attaching said tensioning segments to said support member in such manner that said tensioning segments are movable in a direction of said horizontal axis; and clamping means for fixing said tensioning segments in a predetermined position so as to prevent any movement thereof by pressing said tensioning segments against each other.

2. A device as defined in claim 1 wherein said clamping device includes a pneumatic working cylinder arranged at one end in direction of said horizontal axis and a push rod slidable within said working cylinder and projecting toward an adjacent one of said tensioning segments, said push rod acting on said adjacent tensioning segment to press the plurality of said tensioning segments against each other upon admittance of air into said working cylinder.

3. A device as defined in claim 1 wherein each of said tensioning segments includes a main body and a finger-like extension facing the fabric, said extension being step-shaped so as to have a projection in direction of the fabric and to define a square space.

4. A device as defined in claim 3 wherein said main body is of square shape and has a predetermined width.

5. A device as defined in claim 4 wherein said width is 4–8 mm.

6. A device as defined in claim 3 wherein said projection has a width of approximately 4 mm, a depth of approximately 2 mm and a length of approximately 5 mm.

7. A device as defined in claim 3 wherein said projection has a bottom edge facing said space and said fabric, said bottom edge being provided in a sharp-edged manner.

8. A device as defined in claim 7 wherein said bottom edge is formed by a right angle.

9. A device as defined in claim 1 wherein said connecting means includes a pair of girders arranged at vertical ends of said support member and extending parallel to each other in direction of said horizontal axis, said girders projecting beyond said support member toward said tensioning segments, and a pair of guide plates respectively connected to said girders, said guide plates extending in direction of said vertical axis and opposing each other to define a distance therebetween.

10. A device as defined in claim 9 wherein said girders are an integral part of said support member.

11. A device for tensioning and aligning a fabric, comprising:

a support member having a horizontal and a vertical axis, said support member being lowerable toward the fabric;

a plurality of tensioning segments arranged side by side in direction of said horizontal axis and acting on the fabric when said support member is in the lower position;

connecting means for attaching said tensioning segments to said support member in such a manner that each of said tensioning segments is individually and automatically liftable in direction of said vertical axis, said connecting means including a pair of girders arranged at vertical ends of said support member and extending parallel to each other in direction of said horizontal axis, said girders projecting beyond said support member toward said tensioning segments, and a pair of guide plates respectively connected to said girders, said guide plates extending in direction of said vertical axis and opposing each other to define a distance therebetween, said main body of each tensioning segment being provided with two slots spaced from each other in direction of said vertical axis at a predetermined distance, said slots being outwardly open so as to allow said guide plates to project into said slots when said tensioning segments are to be connected to said support member.

12. A device as defined in claim 11 wherein said distance between said guide plates is larger than the distance between said slots so that said guide plates project into the associated one of said slots with a play thereby allowing each of said tensioning segments to be automatically lifted in direction of said vertical axis wherein the distance between said other one of said girders and said lifted tensioning segments is reduced.

* * * * *